US007225628B2

(12) United States Patent
Furukawa et al.

(10) Patent No.: US 7,225,628 B2
(45) Date of Patent: Jun. 5, 2007

(54) ICE MAKING MACHINE

(75) Inventors: Yoshio Furukawa, Aichi (JP); Nobuhiko Katou, Aichi (JP); Tomoyuki Nishio, Aichi (JP); Yoshikazu Banno, Aichi (JP); Tomohiro Takagi, Aichi (JP); Ryoji Morimoto, Aichi (JP)

(73) Assignee: Hoshizaki Denki Kabushiki Kaisha (JP)

( * ) Notice: Subject to any disclaimer, the term of this patent is extended or adjusted under 35 U.S.C. 154(b) by 351 days.

(21) Appl. No.: 11/017,815

(22) Filed: Dec. 22, 2004

(65) Prior Publication Data

US 2006/0283200 A1 Dec. 21, 2006

(30) Foreign Application Priority Data

Dec. 26, 2003 (JP) ..... 2003-432594

(51) Int. Cl.
*F25C 1/12* (2006.01)

(52) U.S. Cl. ..... 62/137; 62/303; 62/347

(58) Field of Classification Search ..... 62/66–74, 62/137, 303, 340–356
See application file for complete search history.

(56) References Cited

U.S. PATENT DOCUMENTS 3,369,376 A * 2/1968 Kious ..... 62/344
5,237,837 A * 8/1993 Naruse et al. ..... 62/434
6,725,675 B2 * 4/2004 Kampert et al. ..... 62/71
6,857,284 B1 * 2/2005 Brooks ..... 62/303

FOREIGN PATENT DOCUMENTS

JP 3067175 B2 5/2000

* cited by examiner

*Primary Examiner*—William E. Tapolcai
(74) *Attorney, Agent, or Firm*—Rader, Fishman, & Grauer PLLC

(57) ABSTRACT

An ice making machine composed of a water tank for storing an amount of ice making water, an upright ice making plate arranged above the water tank, and a water sprinkler located immediately above the ice making plate to spray ice making water supplied from the water tank to the ice making plate so that the ice making water falls along the ice making plate, in which the ice making water sprayed to the ice making plate during operation at an ice making mode is frozen and formed into ice cubes in the course of falling along the ice making plate. The ice making machine includes a drainage mechanism for draining the ice making water from the water tank, a water supply mechanism for supplying washing water into the water tank, and an electric controller for activating the drainage mechanism after finish of operation at a defrost mode and for activating the water supply mechanism after the ice making water has been drained from the water tank, wherein the washing water supplied into the water tank under control of the controller is sprayed by the water sprinkler for washing the ice making plate.

4 Claims, 13 Drawing Sheets

ICE MAKING MACHINE

BACKGROUND OF THE INVENTION

1. Field of the Invention

The present invention relates to an ice making machine such as an ice making machine of the down-flow type.

2. Discussion of the Prior Art

Disclosed in Japanese Patent Publication No. 3067175 is an ice making machine of the down-flow type in which ice making water in a water tank falls along upright ice making plates in operation at an ice making mode and is circulated into the water tank to be used as washing water. If the ice making water is circulated into the water tank in a contaminated condition, the ice making plates will be washed by the contaminated water, resulting in insufficient washing of the ice making plates.

SUMMARY OF THE INVENTION

It is, therefore, a primary object of the present invention to provide an ice making machine the ice making plates of which are sufficiently washed with fresh water in operation.

According to the present invention, the object is accomplished by providing an ice making machine which comprises a water tank for storing an amount of ice making water, an upright ice making plate arranged above the water tank, and a water sprinkler located immediately above the ice making plate to spray ice making water supplied from the water tank to the ice making plate so that the ice making water falls along the ice making plate, in which the ice making water sprayed to the ice making plate during operation at an ice making mode is frozen and formed into ice cubes in the course of falling along the ice making plate, characterized in that the ice making machine includes drainage means for draining the ice making water from the water tank, water supply means for supplying washing water into the water tank, and control means for activating the drainage means after finish of operation at a defrost mode and for activating the water supply means after the ice making water has been drained from the water tank, wherein the washing water supplied into the water tank under control of the control means is sprayed by the water sprinkler for washing the ice making plate.

In a practical embodiment of the present invention, there is provided an ice making machine which comprises a water tank for storing an amount of ice making water, an upright ice making plate arranged above the water tank, and a water sprinkler located immediately above the ice making plate to spray ice making water supplied from the water tank to the ice making plate so that the ice making water falls along the ice making plate, in which the ice making water sprayed to the ice making plate during operation at an ice making mode is frozen and formed into ice cubes in the course of falling along the ice making plate, characterized in that the ice making machine includes operation means for washing, drainage means for draining the ice making water from the water tank, water supply means for supplying washing water into the water tank, and control means for activating the drainage means when the operation means for washing is operated and for activating the water supply means after the ice making water has been drained from the water tank, wherein the fresh water for washing supplied into the water tank under control of the control means is sprayed by the water sprinkler for washing the ice making plate.

In another practical embodiment of the present invention, there is provided an ice making machine which comprises a water tank for storing an amount of ice making water, an upright ice making plate arranged above the water tank, and a water sprinkler located immediately above the ice making plate to spray ice making water supplied from the water tank to the ice making plate so that the ice making water falls along the ice making plate, in which the ice making water sprayed to the ice making plate during operation at an ice making mode is frozen and formed into ice in the course of falling along the ice making plate, characterized in that the ice making machine includes an ice storage cabinet for storing an amount of ice cubes released from the ice making plate during operation at a defrost mode, detection means for detecting an amount of the ice cubes stored in the ice storage cabinet, drainage means for draining the ice making water from the water tank, water supply means for supplying fresh water for washing into the water tank, and control means for activating the drainage means in response to a detection signal from the detection means when the ice storage cabinet is filled with ice cubes and for activating the water supply means after the ice making water has been drained from the water tank, wherein the fresh water for washing is supplied into the water tank when the water supply means is activated under control of the control means and is sprayed by the water sprinkler for washing the ice making plate.

In the practical embodiments, it is preferable that the ice making machine further includes a guide duct for guiding the ice making water falling from the ice making plate during operation at an ice making mode and for guiding the ice cubes released from the ice making plate during operation at a defrost mode, a water passage duct located at an intermediate portion of the guide duct for circulating the ice making water guided by the guide duct into the water tank, and ice crush means mounted within the guide duct for rotary movement and driven by an electric motor, wherein the ice crush means is driven by operation of the electric motor under control of the control means when the ice making machine is operated at the ice making mode and when the fresh water for washing supplied into the water tank in operation of the water supply means is sprayed by the water sprinkler.

DESCRIPTION OF THE PREFERRED EMBODIMENTS

Hereinafter, preferred embodiments of the present invention will be described with reference to the accompanying drawings.

First Embodiment

Figure 1:
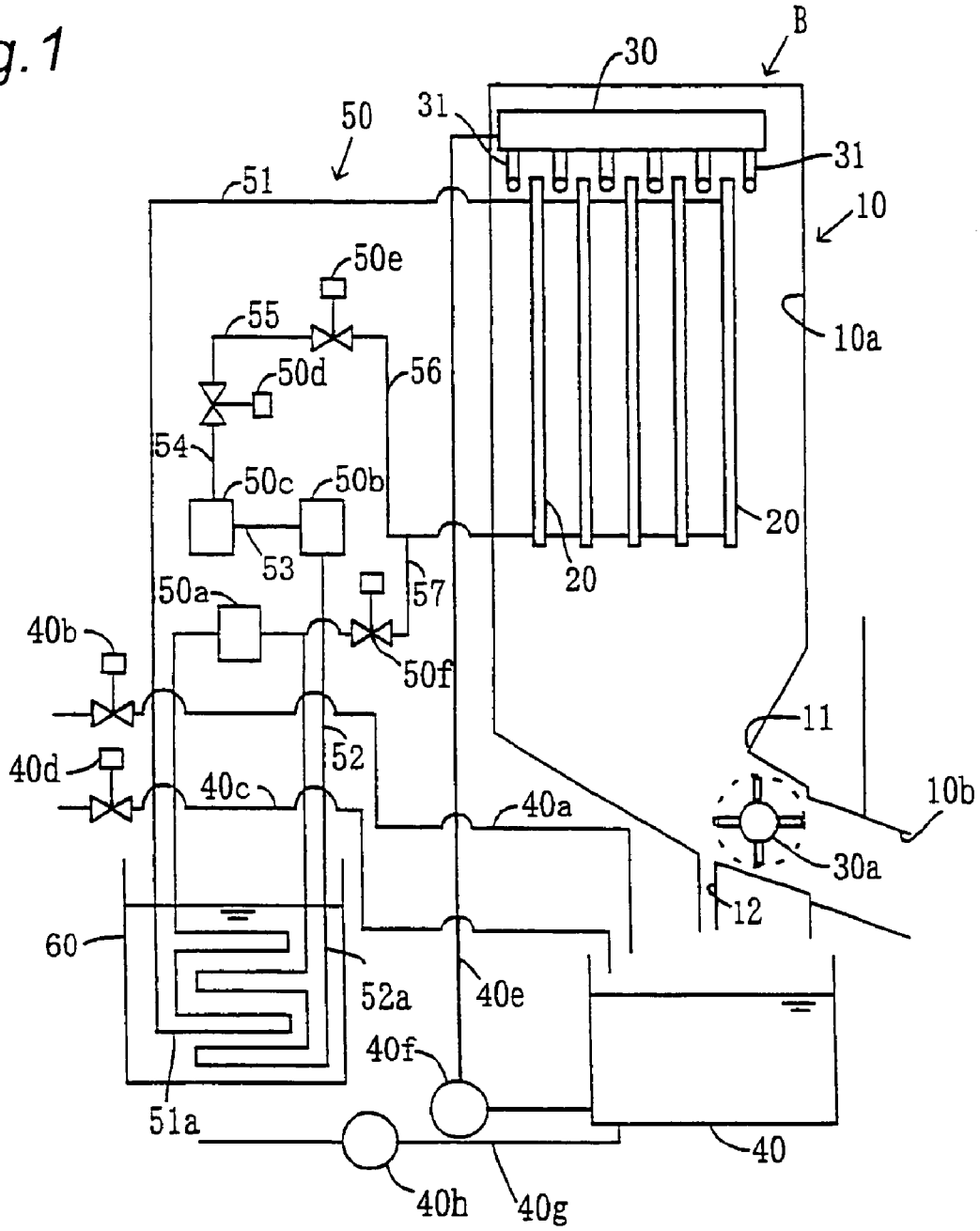
FIG. 1 is a schematic illustration of a first embodiment of an ice making machine in accordance with the present invention.
Figure 2:
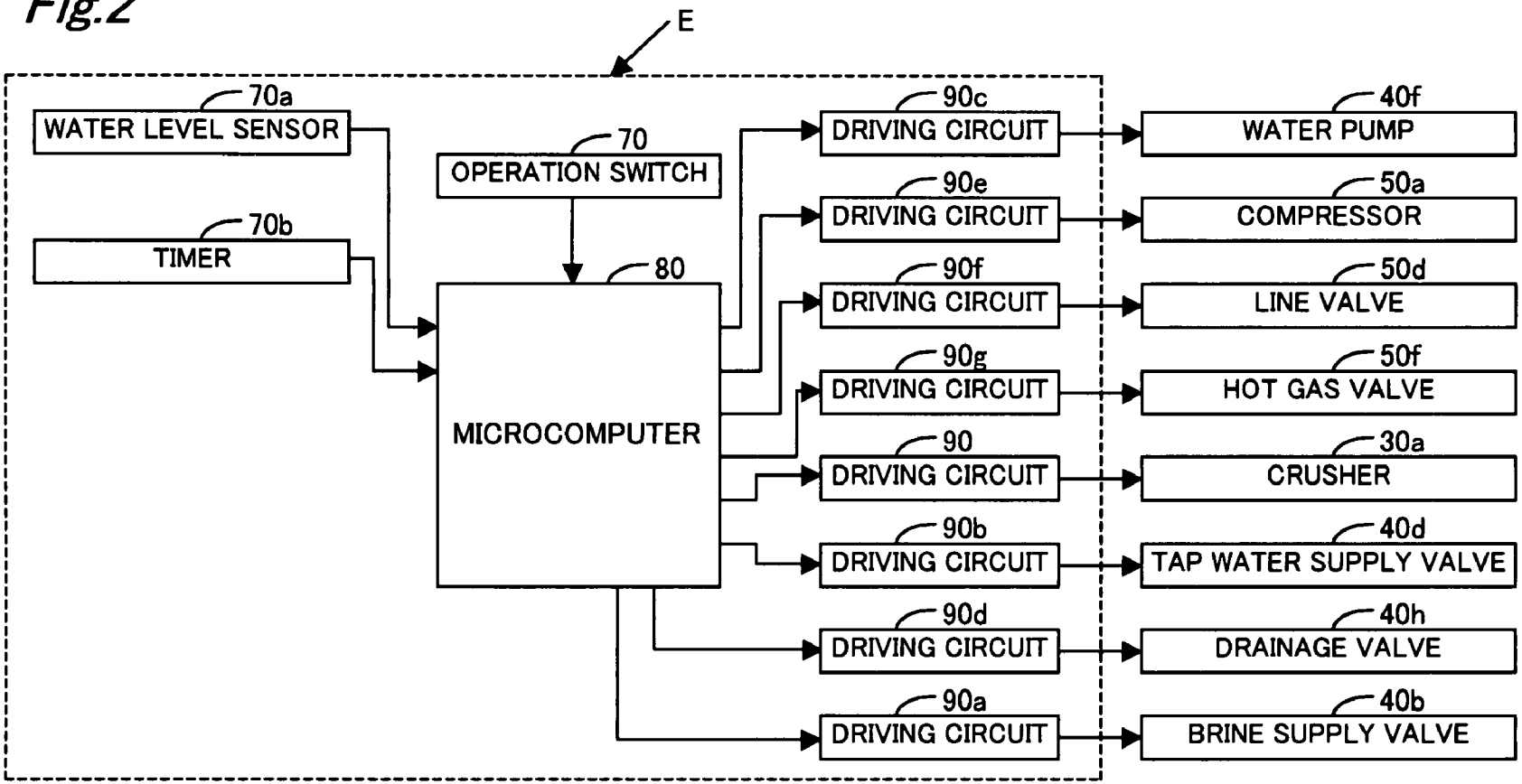
FIG. 2 is a block diagram of an electric control circuit for the ice making machine shown in FIG. 1.

FIG. 1 illustrates a practical embodiment of a large size ice making machine of the down-flow type for industrial use, and FIG. 2 illustrates an electric control circuit E of the ice making machine. As illustrated in FIG. 1, the main body B of the ice making machine is assembled within an upright housing 10 which is composed of a housing body 10*a* provided at its bottom with a guide duct 10*b*. The guide duct 10*b* is inclined downward from the bottom opening 11 of housing body 10*a* to introduce ice making water or washing water falling from the interior of housing body 10*a*.

The main body B of the ice making machine includes an ice making mechanism composed of a plurality of upright ice making plates 20 made of aluminum which are arranged in parallel to each other within the housing body 10*a*. The ice making plates 20 each are integrally formed with refrigerant passages extended transversely in parallel from its upper portion to its lower portion and communicated in series with each other. In the ice making machine, an evaporator is composed of the refrigerant passages.

In the main body B of the ice making machine, a sprinkler 30 is assembled within the housing body 10*a* at a position located above the ice making plates 20 so that ice making water or washing water spouted from nozzles 31 of the sprinkler 30 falls along the surfaces of upright ice making plates 20. An ice crusher 30*a* is mounted within the guide duct 10*b* for rotary movement. The crusher 30*a* is driven by an electric motor to crush ice plates released from the ice making plates 20 into the guide duct 10*b* during operation at a defrost mode and to discharge crushed ice blocks into an ice storage cabinet (not show) placed under the guide duct.

A water tank 40 arranged under the housing body 10*a* is supplied with brine from a source of salt water (not shown) through a brine water supply conduit 40*a* provided thereon with a brine supply valve 40*b* of the normally closed type. The water tank 40 is supplied with tap water for washing from a source of tap water (not shown) through a conduit 40*c* provided with a tap water supply valve 40*d* of the normally closed type. The water tank 40 stores therein an amount of ice making water, washing water or crushed ice blocks introduced into the guide duct 10 from the housing body 10*b* and discharged from a discharge duct 12 mounted to an intermediate portion of guide duct 10*b*. The discharge duct 12 is extended toward the interior of water tank 40 from the intermediate portion of guide duct 10. The source of salt water is arranged to supply sea water as the brine into the water tank.

The ice making water or washing water in water tank 10 is supplied to the sprinkler 30 during operation of a water pump 40*f* disposed in the water supply conduit 40*e*. During operation of the ice making machine at a drain mode, the ice making water or washing water in water tank 40 is drained by operation of a drainage pump 40*h* disposed in a drain conduit 40*g*.

A freezing circuit 50 assembled with the main body B of the ice making machine includes a compressor 50*a* whose inlet port is communicated with an outlet port of the evaporator integral with the ice making plates 20 through a conduit 51. The compressor 50*a* is driven under control of the computer to compress the refrigerant circulated from the evaporator through a conduit 51 and to discharge the compressed refrigerant of high temperature under pressure into a condenser 50*b*.

The condenser 50*b* condenses the compressed refrigerant from compressor 50*a* and causes the condensed refrigerant to flow into an air-liquid separator 50*c* through a conduit 53. The air-liquid separator 50*c* separates the condensed refrigerant into air and liquid and causes the refrigerant of liquid phase into an electromagnetic line valve 50*d* of the normally closed type through a conduit 54. When opened, the line valve 50*d* causes the refrigerant of liquid phase from air-liquid separator 50*c* to flow into an expansion valve 50*e* through a conduit 55. When closed, the electromagnetic line valve 50*d* interrupts the flow of refrigerant of liquid phase into an expansion valve 50*e*. The expansion valve 50*e* converts the refrigerant of liquid phase from electromagnetic line valve 50*d* into circulation refrigerant of low temperature under low pressure in accordance with a heated degree of the refrigerant at the outlet portion of the evaporator and causes the circulation refrigerant to flow into the inlet portion of the evaporator through a conduit 56.

The evaporator is arranged to cool each ice making plate 20 with the circulation refrigerant supplied from expansion valve 50*e* and to circulate the circulation refrigerant into the compressor 50*a* through the conduit 51. The evaporator also acts to heat each ice making plate 20 with hot gas supplied from a hot-gas valve 50*f* of the normally closed type as described later and to circulate the hot gas into the compressor 50*a* through the conduit 51.

The hot-gas valve 50*f* is disposed in an intermediate portion of a bypass conduit 57 connected to each intermediate portion of conduits 52 and 56. When opened, the hot-gas valve 50*f* causes the compressed refrigerant from compressor 50*a* to flow as the hot gas into the inlet portion of the evaporator through an upstream portion of conduit 52, bypass conduit 57 and a downstream portion of conduit 56. When closed, the hot-gas valve 50*f* interrupts the flow of hot gas into the evaporator.

A hot water tank 60 is provided to store an amount of hot water and contains a intermediate bent portion 51*a* of conduit 51 and an intermediate portion 52*a* of conduit 52 immersed in hot water stored therein. The hot water in tank 60 is warmed by the compressed refrigerant of high temperature under high pressure flowing through the intermediate portion 52*a* of conduit 52 from compressor 50*a*. The circulation refrigerant flowing through the intermediate portion 51 of conduit 51 is warmed by the hot water in tank 60 and evaporates. This effects to prevent recirculation of the refrigerant at liquid phase into the compressor 50*a*.

Hereinafter, the electric control circuit E will be described with reference to FIG. 2. The electric control circuit E includes an operation switch 70 which is operated to start activation of the ice making machine. A water level sensor 70*a* is provided to detect the level of ice making water in the water tank 40, and a timer 70*b* is provided to start time measurement when reset under control of the microcomputer 80.

The microcomputer 80 is provided in the electric control circuit to execute a control program shown by a flow chart in FIGS. 3 to 6. During execution of the control program based on outputs of water level sensor 70*a* and timer 70*b*, the computer 80 executes processing for control of the crusher 30*a*, brine supply valve 40*b*, tap water supply valve 40*d*, water pump 40*f*, drainage pump 40*h*, compressor 50*a*, electromagnetic line valve 50*d* and hot gas valve 50*f* through driving circuits 90, 90*a*–90*g*. When the operation switch 70 is operated, the computer 80 initiates to execute the control program memorized in its ROM.

The driving circuit 90 is activated under control of the computer 80 to rotate the crusher 30*a* in a counterclockwise direction in FIG. 1. The driving circuit 90*a* is activated under control of the computer 80 to open and close the brine supply valve 40*b*. The driving circuit 90*b* is activated under control of the computer 80 to open and close the tap water supply valve 40*b*. The driving circuit 90*c* is activated under control of the computer 80 to drive the water pump 40*f*. The driving circuit 90*d* is activated under control of the computer 80 to drive the drainage pump 40*h*. The driving circuit 90*e* is activated under control of the computer 80 to drive the compressor 50*a*. The driving circuit 90*f* is activated under control of the computer 80 to open and close the electromagnetic line valve 50*d*. The driving circuit 90*g* is activated under control of the computer 80 to open and close the hot gas valve 50*f*.

Figure 3:
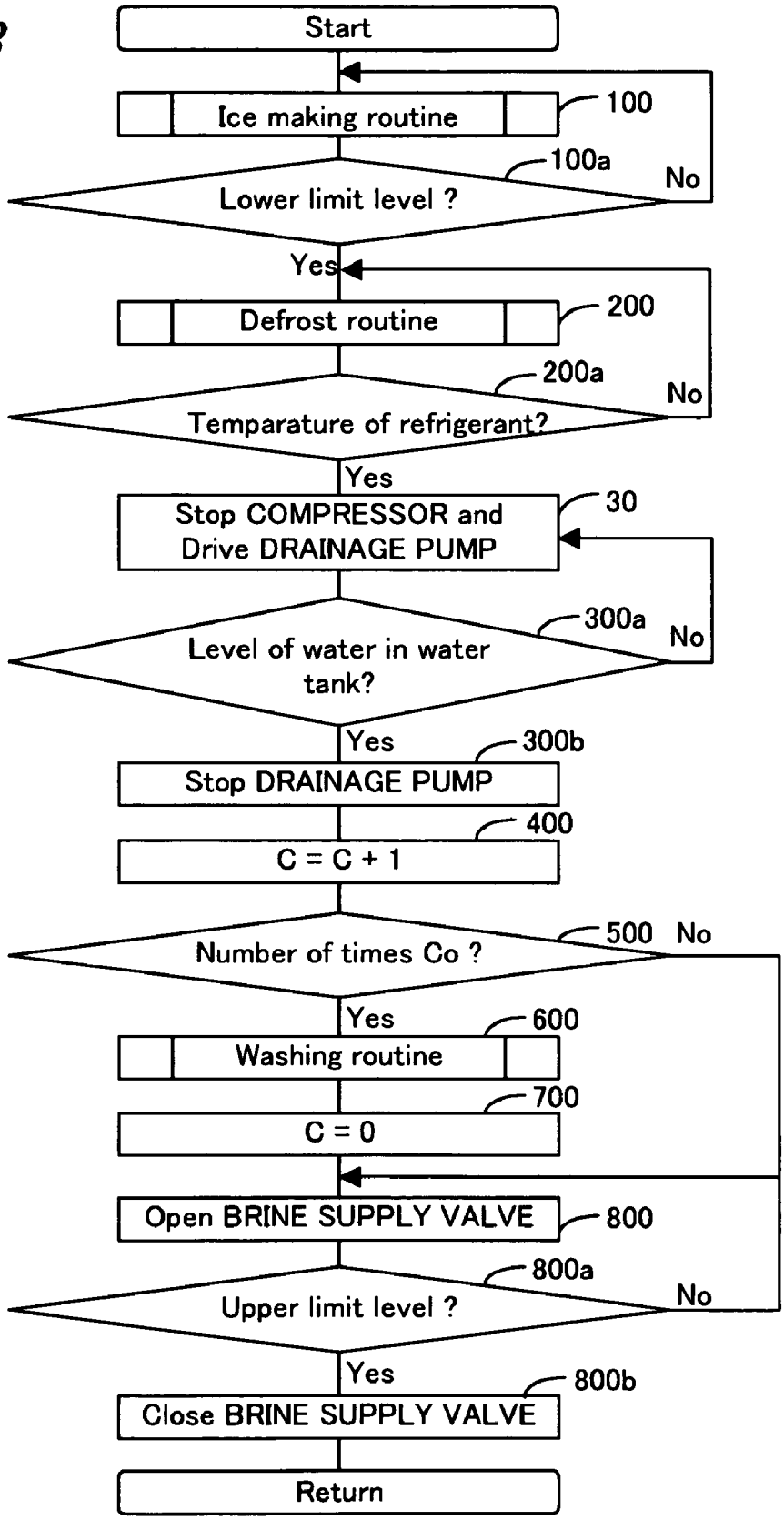
FIG. 3 is a flow chart of a control program executed by a microcomputer shown in FIG. 2.
Figure 4:
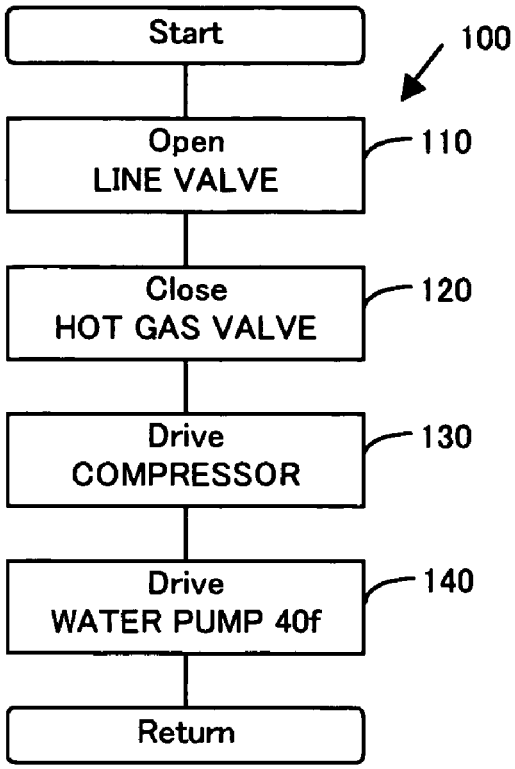
FIG. 4 is a flow chart of an ice making routine shown in FIG. 3.

When the operation switch 70 is operated to activate the ice making machine, the computer 80 initiates to execute processing of an ice making routine 100 of the control program as shown in a flow chart of FIG. 3. In processing of the ice making routine 100, the electromagnetic line valve 50 is opened by activation of the driving circuit 90*f* under control of the computer 80 at step 110 of FIG. 4. After processing at step 110, the hot gas valve 50*f* is closed by activation of the driving circuit 90*g* under control of the computer 80 at step 120. Subsequently, the compressor 50*a* is driven by activation of the driving circuit 90*e* under control of the computer 80 at step 130 of FIG. 4 to compress the refrigerant circulated into conduit 51 from the evaporator so that the compressed refrigerant of high temperature under high pressure flows into the condenser 50*b* through conduit 52.

The compressed refrigerant is condensed by the condenser 50*b* and separated into air and liquid at the air-liquid separator 50*c*. When the refrigerant of liquid phase from separator 50*c* flows into the expansion valve 50*e* through the electromagnetic line valve 50*d*, the expansion valve 51 converts the refrigerant of liquid phase to refrigerant of low temperature under low pressure and causes it to flow as circulation refrigerant into the evaporator. Thus, the ice making plates 20 are cooled by the circulation refrigerant flowing into the evaporator, and the circulation refrigerant circulates into the compressor 50*a*.

After processing at step 130, the water pump 40*f* is driven at step 140 by activation of the driving circuit 90*c* under control of the computer 80 to supply the ice making water from the water tank 40 to the sprinkler 30 through the conduit 40*e*. The ice making water is sprayed to the ice making surfaces of plates 20 from nozzles 31 of the sprinkler 30 and falls along the ice making surfaces of plates 20. Thus, the ice making water circulates into the water tank 40 through the discharge passage 12 of the guide duct 10*b*.

In such a manner as described above, the ice making machine is operated at the ice making mode such that the ice making water is frozen by the evaporator and formed into ice plates on the ice making surfaces in the course of falling along the ice making surfaces of upright plates 20. When the level of ice making water in water tank 40 lowers less than a lower limit level, the computer 80 determines a "Yes" answer at step 100*a* of FIG. 3 in response to a detection signal from the water level sensor 70*a* and causes the program to proceed to a defrost routine 200 shown in FIG. 5. In the defrost routine 200, the computer 80 executes processing for stopping the water pump 40*f* at step 210. With this processing, the water pump 40*f* is stopped under control of the driving circuit 90*c* to stop the supply of ice making water from the water tank 40 to the sprinkler 30.

After processing at step 210, the hot gas valve 50*f* is opened by activation of the driving circuit 90*g* under control of the computer at step 220, and the electromagnetic line valve 50*d* is closed by activation of the driving circuit 90*f* under control of the computer at step 230 to interrupt the refrigerant from the air-liquid separator 50*c* to the expansion valve 50*e*. Thus, the compressed refrigerant from compressor 50*a* flows as hot gas into the evaporator through the hot gas valve 50*f* such that the ice plates formed on the ice making plates 20 are molten by the hot gas and released from the ice making plates to be introduced into the guide duct 10*b*.

After processing at step 230, the crusher 30*a* is driven by activation of the driving circuit 90 under control of the computer at step 240 such that the ice plates introduced into the guide duct 10*b* are crushed by operation of the crusher and introduced into an ice storage cabinet (not shown). During such operation of the ice making machine at the defrost mode, the ice plates formed on the ice making plates are crushed and stored in the ice storage cabinet. When the temperature of refrigerant at a position near the outlet portion of the evaporator rises more than a predetermined temperature for completion of the defrost, the computer determines a "Yes" answer at step 200*a* in response to a detection signal from a temperature sensor (not shown) placed at the position near the outlet portion of the evaporator.

When the "Yes" answer is determined at step 200*a*, the computer executes at step 300 processing for stopping the compressor 50*a* and for driving the drainage pump 40*h*. With this processing, the compressor 50*a* is stopped, and the drainage pump 40*h* is driven by activation of the driving circuit 90*d* under control of the computer to drain the ice making water remained in the water tank 40 after operation at the ice making mode. When the level of ice making water becomes the lowest level, the computer 80 determines a "Yes" answer at step 300*a* in response to a detection signal from the water level sensor 70*a* and executes processing for stopping the drainage pump 40*h* at step 300*b*. Thus, the drainage pump 40*h* is stopped under control of the computer to finish drainage of the ice making water from the water pump 40.

Subsequently, the computer renews a measurement data C to C=C+1 on a basis of a measurement data C=0 at step 700. This means that the processing at step 100 to 300*b* has been once executed in operation at the ice making mode and the defrost mode. Since the measurement data C at this stage is still less than a predetermined number of times Co, the computer determines a "No" answer at step 500 and executes processing for opening the brine supply valve 40*b* at step 800. With this processing, the brine supply valve 40*b* is opened by activation of the driving circuit 90*a* so that the brine from the source of salt water is supplied as ice making water to the water tank 40.

When the level of ice making water in water tank 40 rises up to an upper limit level, the computer determines a "Yes"

answer at step 800*a* in response to a detection signal from the water level sensor 70*a* and executes processing for closing the brine supply valve 40*b* at step 800*b*. With this processing, the brine supply valve 40*b* is closed to stop the supply of brine to the water tank 40. Thereafter, the processing for operation at the ice making mode and the defrost mode, for draining the ice making water from water tank 40, and for supplying the ice making water to the water tank 40 is repeatedly executed while the "No" answer is determined at step 500. Thus, the ice blocks of brine are stored in the ice storage cabinet.

During such operation of the ice making machine as described above, the ice making water in water tank 40 is drained at each finish of operation at the defrost mode, and the water tank 40 is supplied with fresh brine as the ice making water in operation at the subsequent ice making mode to produce ice plates of the fresh brine. When the measurement data C is renewed at step 500 more than the predetermined number of times Co, the computer determines a "Yes" answer and executes at step 600 processing of a washing routine shown in FIG. 6.

During processing of the washing routine 600, the tap water supply valve 40*d* is opened by activation of the driving circuit 90*b* under control of the computer at step 610 so that the water tank 40 is supplied with tap water for washing. When the level of tap water for washing in water tank 40 rises up to the limit level, the computer determines a "Yes" answer at step 610*a* and executes processing for closing the tap water supply valve 40*d* at step 610*b*. Thus, the tap water supply valve 40*d* is closed by activation of the driving circuit 90*b* under control of the computer to stop the supply of tap water into the water tank 40.

After processing at step 610*b*, the water pump 40*f* is driven by activation of the driving circuit 90*c* under control of the computer at step 620 to supply the tap water for washing to the sprinkler 30 through the water supply conduit 40*e*. Thus, the tap water for washing is sprayed from the nozzles of sprinkler 30 toward each upper portion of ice making plates 20 and falls along the ice making plates 20. In such an instance, the tap water for washing is discharged through the discharge passage 12 of guide duct 30*b* and circulated into the water tank 40.

After finish of the processing at step 620, the timer 70*b* of the computer is reset at step 620*a* to start measurement of a predetermined time for washing. Accordingly, the computer determines a "No" answer at step 620*b* repeatedly during lapse of the predetermined time for washing, and the ice making plates 20 are washed by the tap water for washing during operation of the water pump 40*f* under control of the computer. Upon lapse of the predetermined time for washing, the computer determines a "Yes" answer at step 620*b* and executes processing for stopping the water pump 40*f* at step 620*c*. Thus, the water pump 40*f* is stopped by activation of the driving circuit 90*c* under control of the computer to stop the supply of the tap water for washing to the sprinkler 30.

After processing at step 620*c*, the drainage pump 40*h* is driven by activation of the driving circuit 90*d* under control of the computer at step 630 thereby to drain the circulated tap water for washing from the water tank 40 through the drain conduit 40*g*. When the level of tap water in water tank 40 lowers less than the lower limit level, the computer determines a "Yes" answer at step 630*a* in response to a detection signal from the water level sensor 70*a* and executes processing for stopping the drainage pump 40*h* at step 630*b*. Thus, the drainage pump 40*h* is stopped by activation of the driving circuit 90*d* under control of the computer to stop drainage of the tap water for washing from the water tank 40.

As is understood from the above description, the water tank 40 is supplied with fresh tap water for washing from the source of tap water through the tap water supply valve 40*d* after the ice making water was drained, and the ice making plates 20 are washed by the tap water spouted from the sprinkler 40 during operation of the water pump 40*f*. Accordingly, the water circulation system such as the sprinkler 30, ice making plates 20, guide duct 10*b*, discharge passage 12 and water tank 40 is washed with fresh tap water. Thus, salt component adhered to the water circulation system during operation at the ice making mode will be cleanly eliminated with the fresh tap water. As a result, the water circulation system is maintained in a clean condition without being corroded by salt component in the ice making water. Since the washing routine 600 is processed at each time when the "Yes" answer is determined at step 500, the water circulation system is automatically washed without any works for washing.

When the processing of the washing routine 600 is finished, the measurement data C is cleared as C=0 at step 700. Thereafter, processing at step 800–800*b* is executed in the same manner as that at the time when the "No" answer was determined at step 500. Thus, until the level of brine in water tank 40 becomes the upper limit level, the brine supply valve 40*b* is maintained in an open position to supply the brine to the water tank 40 through the brine supply conduit 40*a*. After the water circulation system has been washed, the operation at the ice making mode is automatically started.

During operation of the ice making machine, the hot water in tank 60 is warmed by the compressed refrigerant flowing from the compressor 50*a* to the intermediate portion 52*a* of conduit 52. Thus, the refrigerant of liquid phase circulated to the compressor 50*a* from the evaporator vaporizes at the intermediate portion 51*a* of conduit 51. This is useful to avoid damage of the compressor 50*a* caused by circulation of the refrigerant of liquid phase.

Second Embodiment

Figure 7:
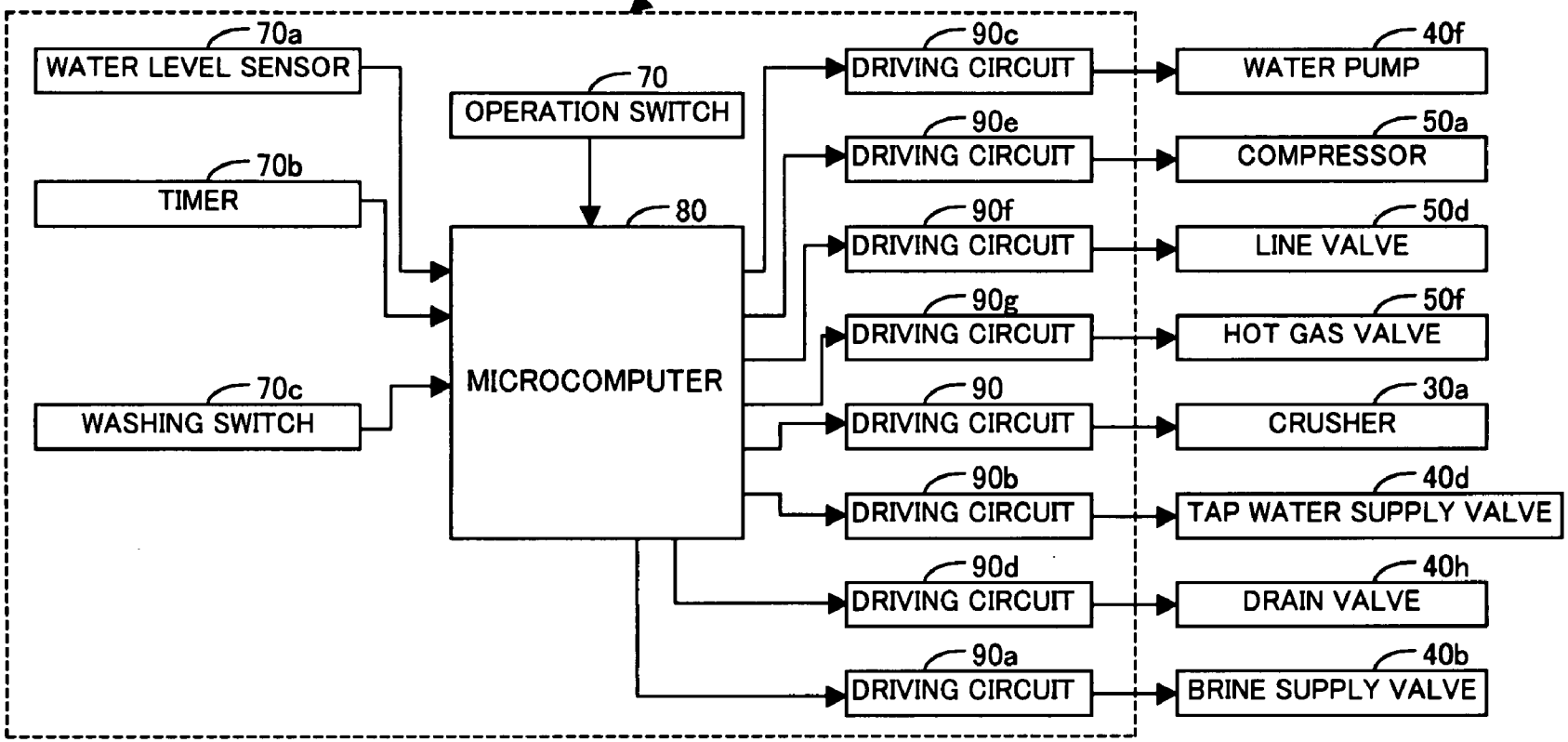
FIG. 7 is a block diagram of an electric control circuit in a second embodiment of the present invention.
Figure 8:
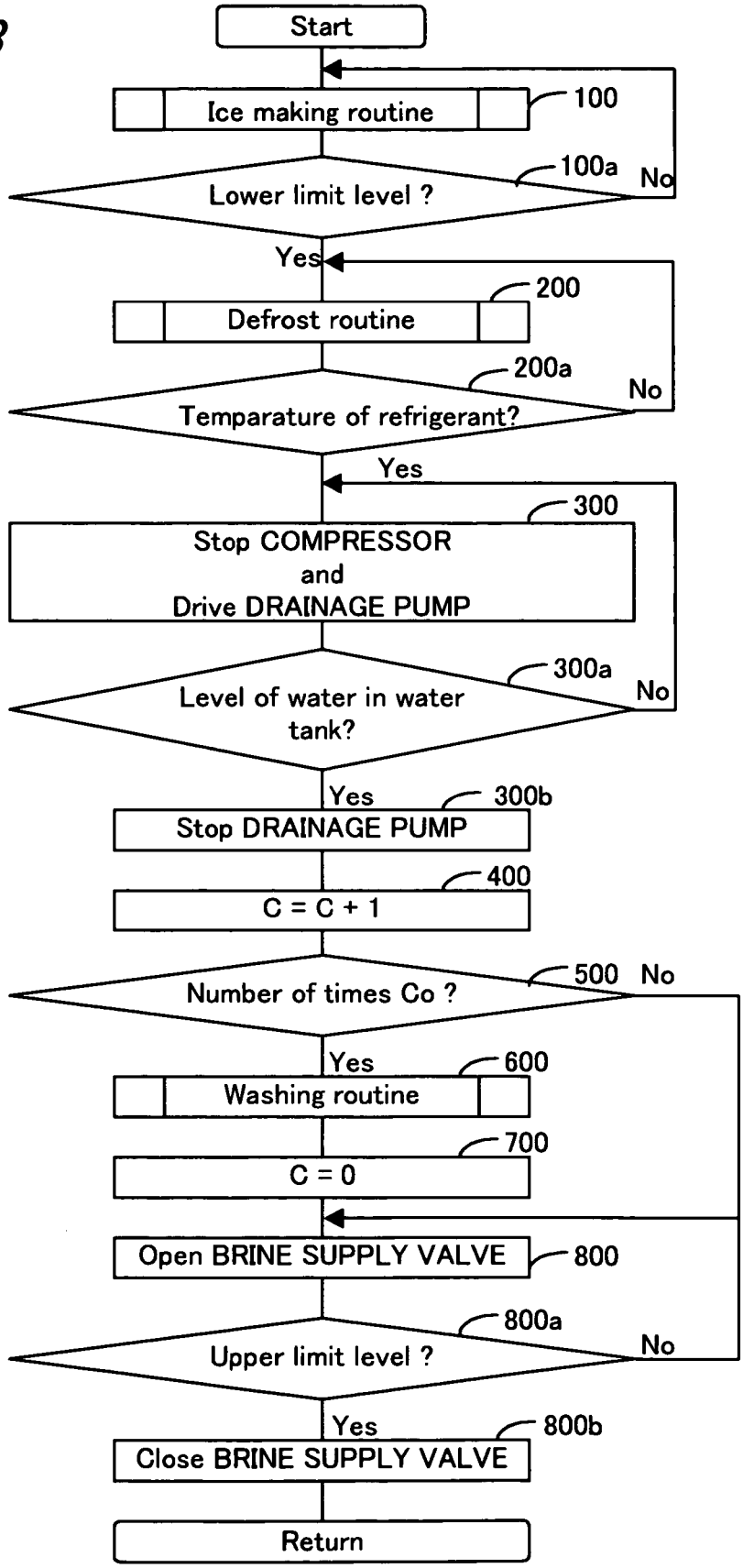
FIG. 8 is a flow chart of the main portion of a control program executed by a microcomputer shown in FIG. 7.

Illustrated in FIGS. 7 and 8 is a second embodiment of the present invention, wherein an operation switch 70*c* for washing is added to the electric control circuit E to be operated for washing the water circulation system described above.

In this second embodiment, a control program shown by a flow chart in FIG. 8 is substituted for the control program shown by the flow chart in FIG. 3. The other construction is the same as that of the first embodiment. In this second embodiment, the computer executes processing for stopping the drainage pump 40*h* at step 300*b* as in the first embodiment. Thereafter, the computer determines at step 500*a* whether the operation switch 70*c* for washing has been operated or not. If the operation switch 70*c* is not operated, the computer determines a "No" answer at step 500*a* and executes the processing at step 800 and at the following step in the same manner as in the first embodiment. When the operation switch 70*c* for washing is operated, the computer determines a "Yes" answer at step 500*a* and executes the processing of the washing routine 600 in the same manner as in the first embodiment. The water circulation system is washed with fresh tap water by processing of the washing routine 600.

Third Embodiment

Figure 6:
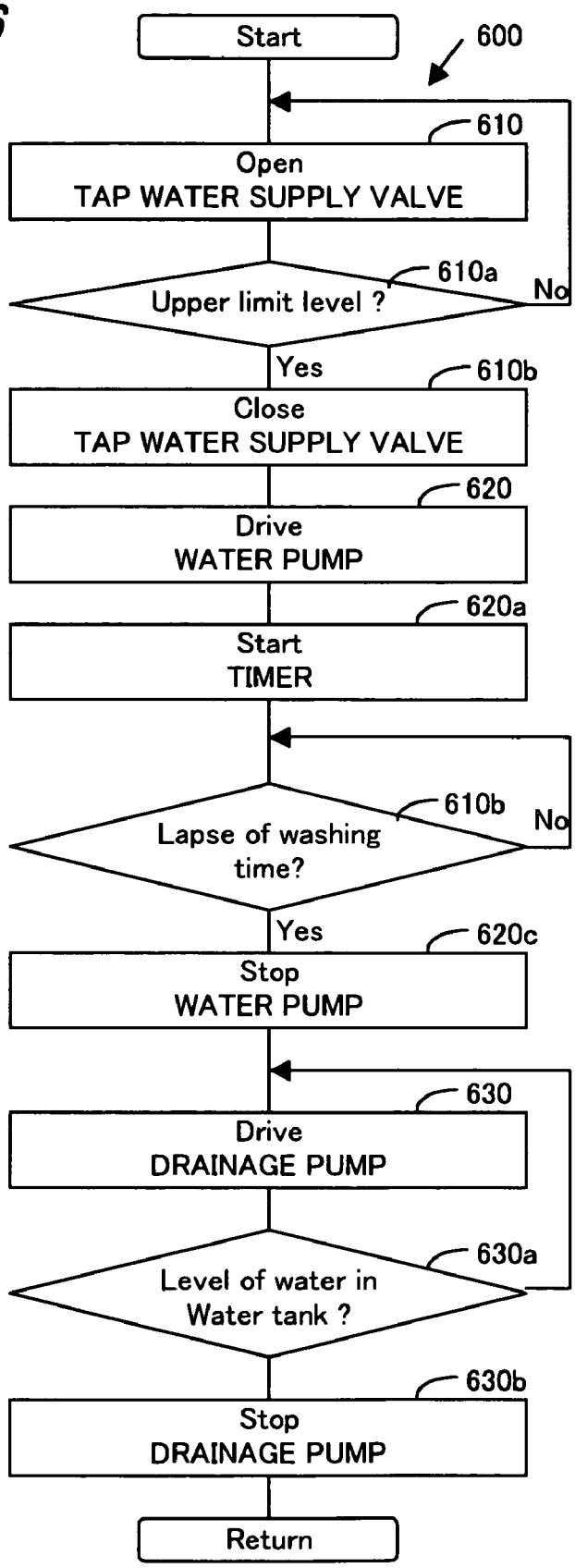
FIG. 6 is a flow chart of a washing routine shown in FIG. 3.
Figure 9:
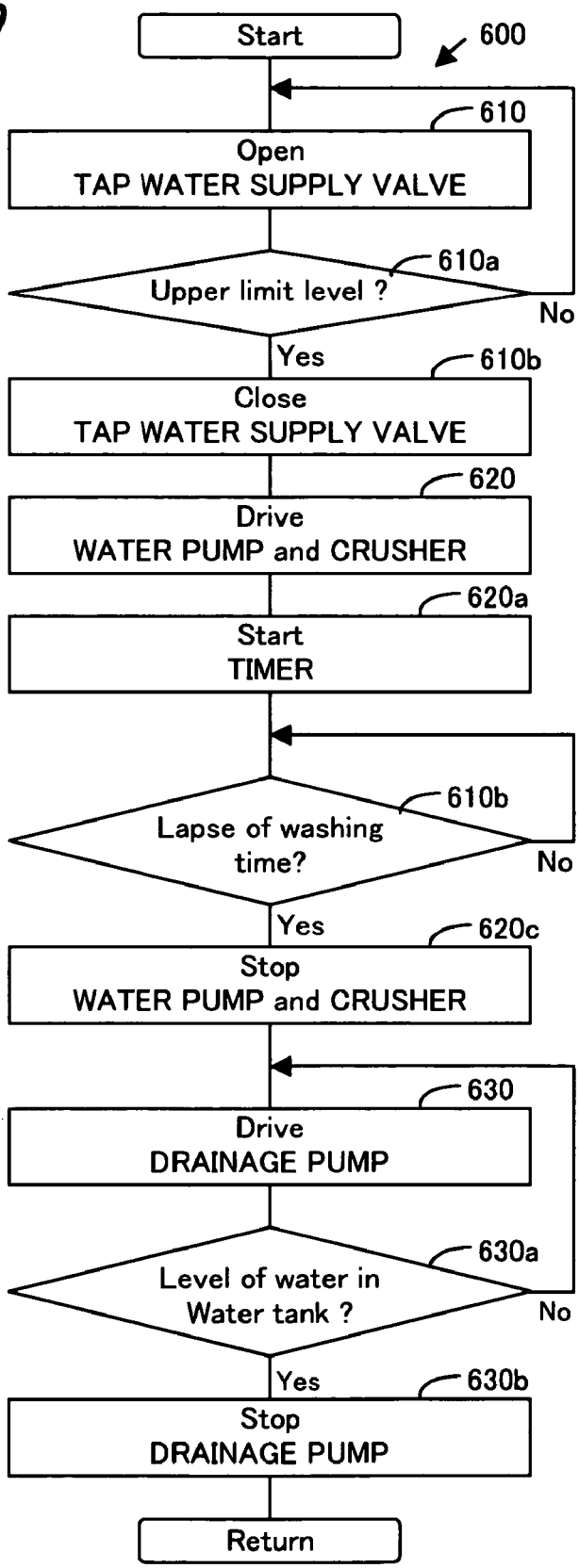
FIG. 9 is a flow chart of a control program executed by a microcomputer in a third embodiment of the present invention.

Illustrated in FIG. 9 is a third embodiment of the present invention, wherein a washing routine at step 600 in FIG. 9 is substituted for the washing routine at step 600 in FIG. 6. The other construction is the same as that in the first embodiment. In this third embodiment, the computer executes processing for closing the tap water supply valve 40*b* at step 610*b* as in the first embodiment. Thereafter, the computer executes processing for driving the water pump 40*f* and for driving the ice crusher 30*a* at step 620*d* in FIG. 9. Thus, under control of the computer, the water pump 40*f* is driven by activation of the driving circuit 90*c* to supply the tap water for washing to the sprinkler 30 from the water tank 40, and the ice crusher 30*a* is driven by activation of the driving circuit 90. The tap water for washing is spouted from the nozzles of sprinkler 30 toward the ice making plates 20 and falls along the ice making plates 20 to wash the ice making surfaces of them. The tap water for washing is discharged through the guide duct 30*b* and circulated into the water tank 40 through the discharge passage 12. In such an instance, the crusher 30*a* is washed by the tap water falling from the ice making plates 20, while the internal surface of guide duct 10*b* is washed by the tap water picked up by rotation of the crusher 30*a*.

Fourth Embodiment

Figure 10:
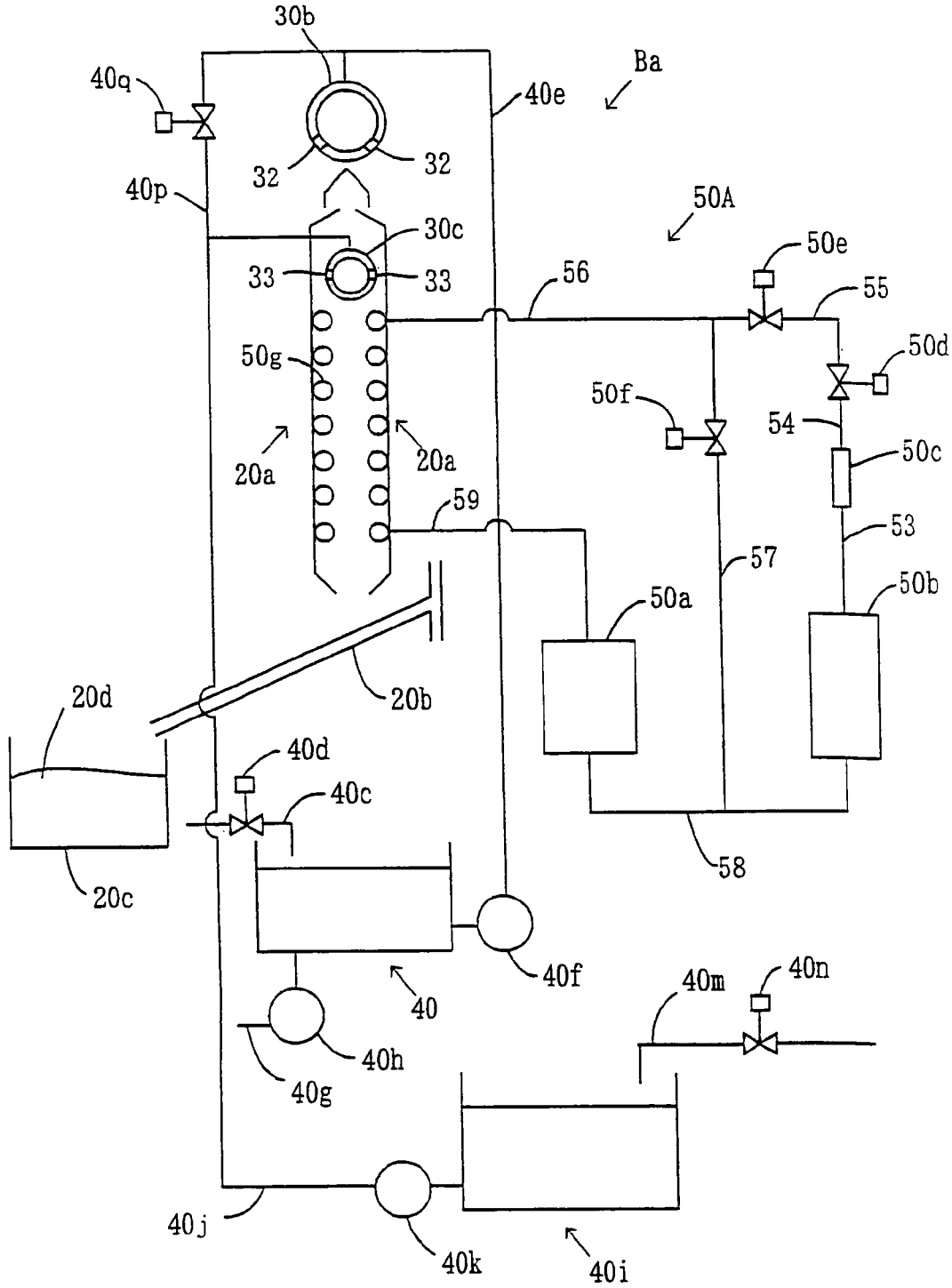
FIG. 10 is a schematic illustration of a fourth embodiment of the present invention.
Figure 11:
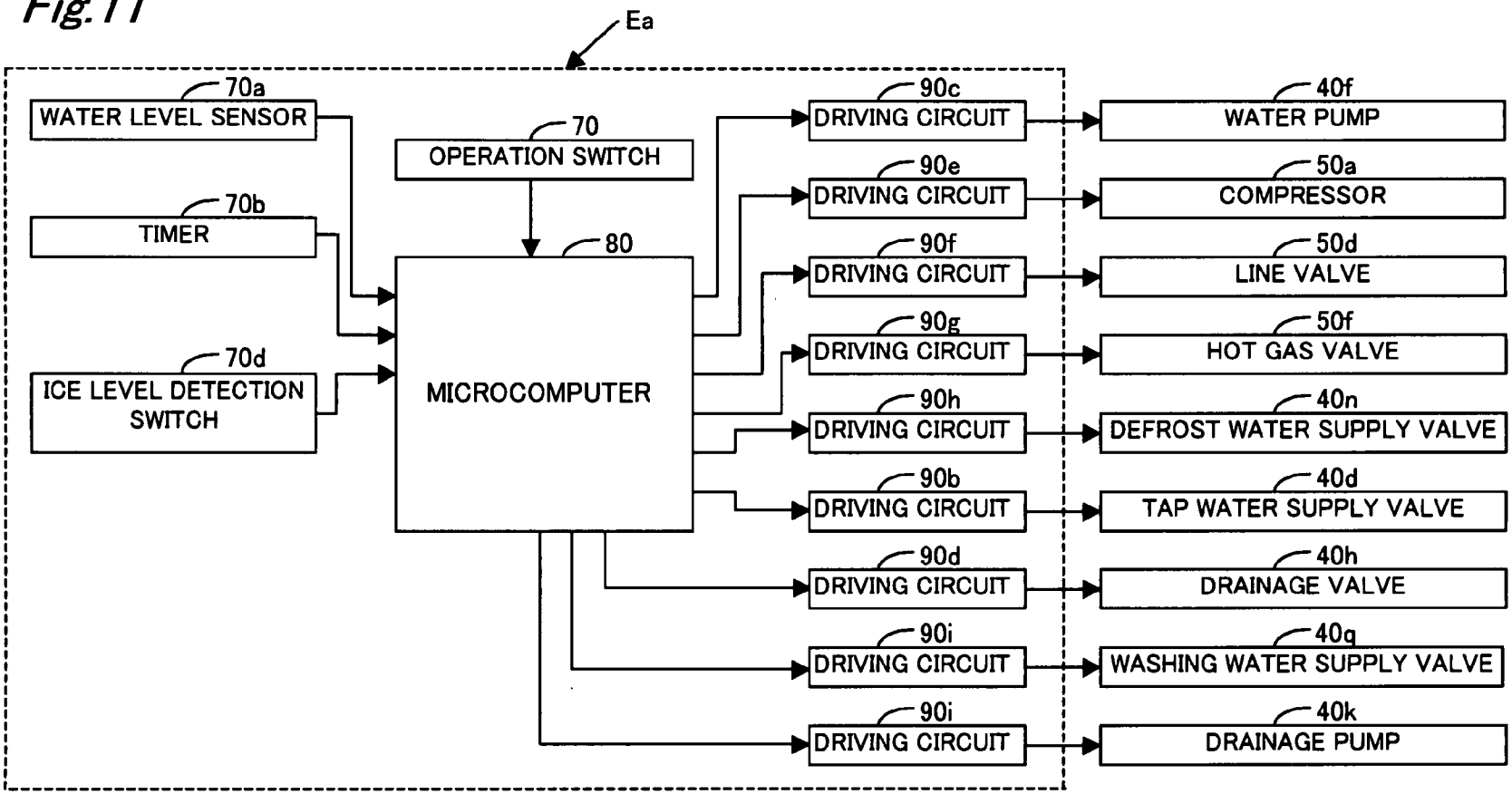
FIG. 11 is a block diagram of an electric control circuit in the fourth embodiment.

Illustrated in FIGS. 10–14 is a fourth embodiment of the present invention, wherein a small size ice making machine of the down-flow type is substituted for the large size ice making machine in the first embodiment. As shown in FIGS. 10 and 11, the small size ice making machine is composed of a main body Ba thereof and an electric control circuit Ea.

The main body Ba of the ice making machine includes a pair of upright ice making plates 20*a* arranged in parallel and upper and lower sprinklers 30*b*, 30*c*. The upper side sprinkler 30*b* is arranged above the ice making plates 20*a* to spray ice making water or washing water toward each upper end of the ice making plates 20*a* from its nozzles 32. The lower side sprinkler 30*c* is placed between the upper portions of ice making plates 20*a* to sprinkle defrost water or washing water toward the back surfaces of the ice making plates 20*a* from its nozzles 33.

The main body Ba of the ice making machine further includes a meshed guide member 20*b* and an ice storage cabinet 20*c* and includes a water tank 40 and a water pump 40*f* as in the first embodiment. The water tank 40 is located under the ice making plates 20*a*, and the guide member 20*b* is inclined toward the ice storage cabinet 20*c* to receive ice blocks formed on the outer surfaces of the ice making plates 20*a* and introduce them into the ice storage cabinet 20*c*.

The water tank 40 is provided to store an amount of tap water supplied from a source of tap water through a tap water supply valve 40*d*. In this embodiment, the tap water is used as ice making water or washing water. The water pump 40*f* is provided to supply the tap water from water tank 40 to the sprinklers 30*a*, 30*b* through a water supply conduit 40*e*. A drainage pump 40*h* is provided to drain the tap water from the water tank 40 as in the first embodiment.

The main body Ba of the ice making machine further includes a defrost water tank 40*i* and a defrost water supply valve 40*n* of the normally closed type. The defrost water supply valve 40*n* is disposed in a defrost water supply conduit 40*m* to supply tap water from the source of defrost water as defrost water to the defrost water tank 40*i* in its open position. A water supply pump 40*k* is disposed in a water supply conduit 40*j* to supply the defrost water from the defrost water tank 40*i* to the sprinkler 30*c* in its activated condition.

A washing water supply valve 40*q* is disposed in a conduit 40*p* between downstream portions of the water supply conduits 40*j* and 40*e* to supply washing water from the water supply pump 40*f* to the sprinkler 30*c* through conduits 40*e* and 40*p* in its open position. When closed, the washing water supply valve 40*q* interrupts the supply of washing water to the sprinkler 30*c*.

The main body Ba of the ice making machine is provided with a freezing circuit 50A which includes the compressor 50*a* as in the first embodiment for supplying compressed refrigerant to the condenser 50*b* through a conduit 58. The freezing circuit 50A further includes a coiled evaporator 50*g* which is disposed between the ice making plates 20*a* to cool the ice making plates. The evaporator 50*g* is connected at its inlet portion to an expansion valve 50*e* through a conduit 56 and at its outlet portion to the compressor 50*a* through a conduit 59. The other construction of the freezing circuit 50A is substantially the same as that in the first embodiment.

Figure 5:
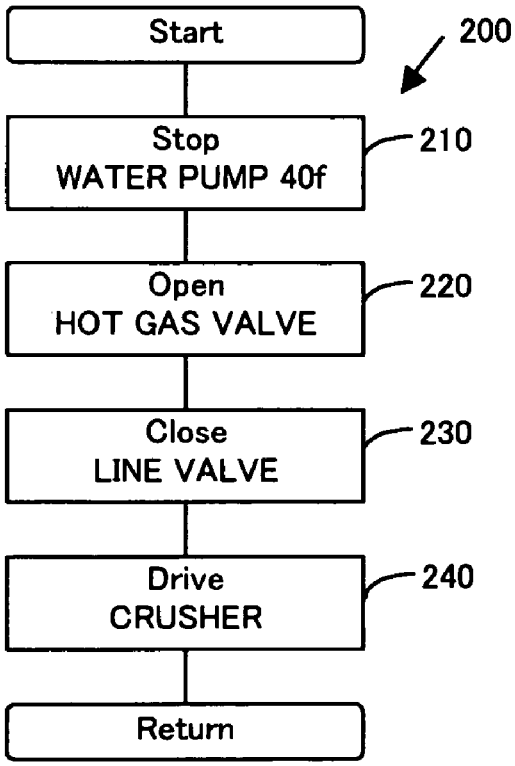
FIG. 5 is a flow chart of a defrost routine shown in FIG. 3.
Figure 12:
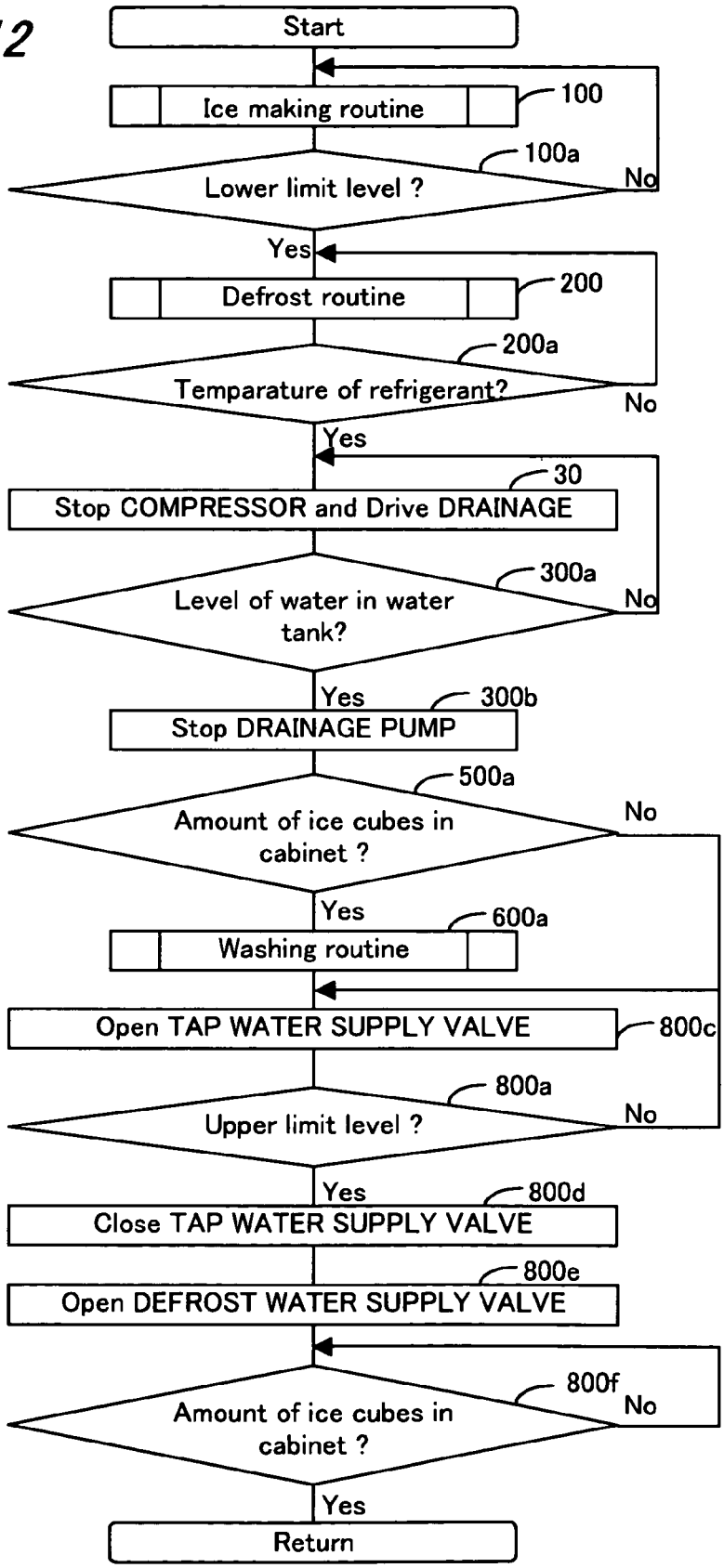
FIG. 12 is a flow chart of a control program executed by a microcomputer shown in FIG. 11.
Figure 13:
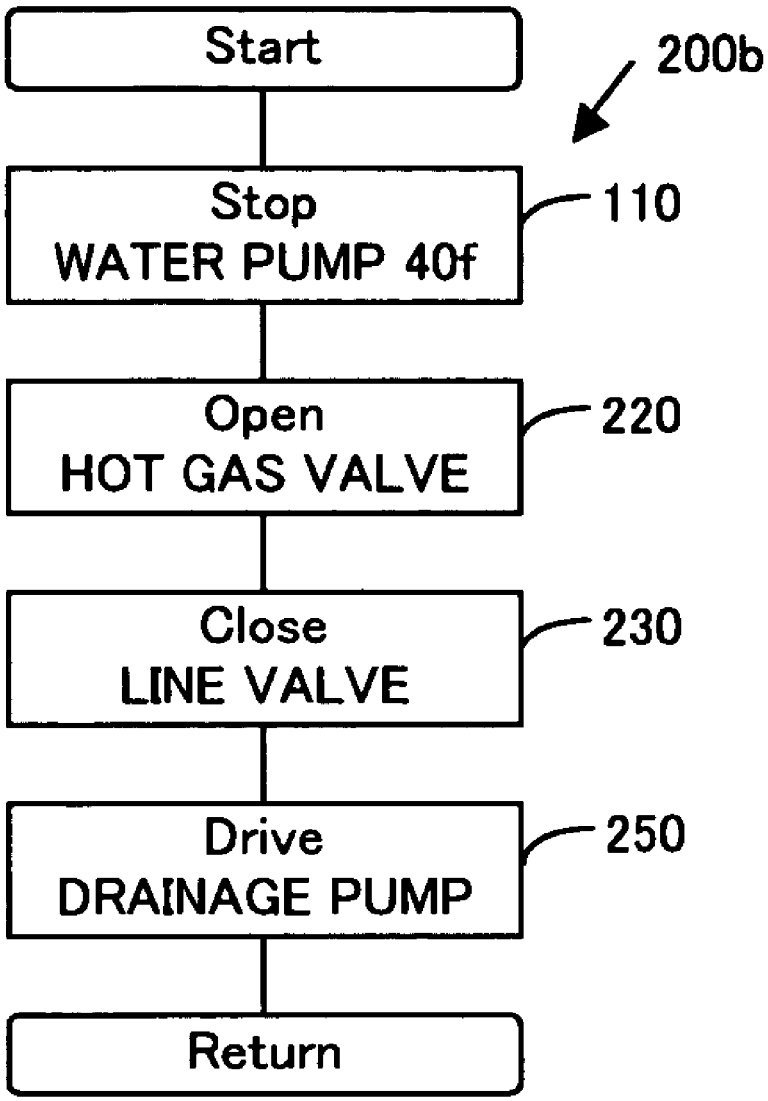
FIG. 13 is a flow chart of a defrost routine shown in FIG. 12.
Figure 14:
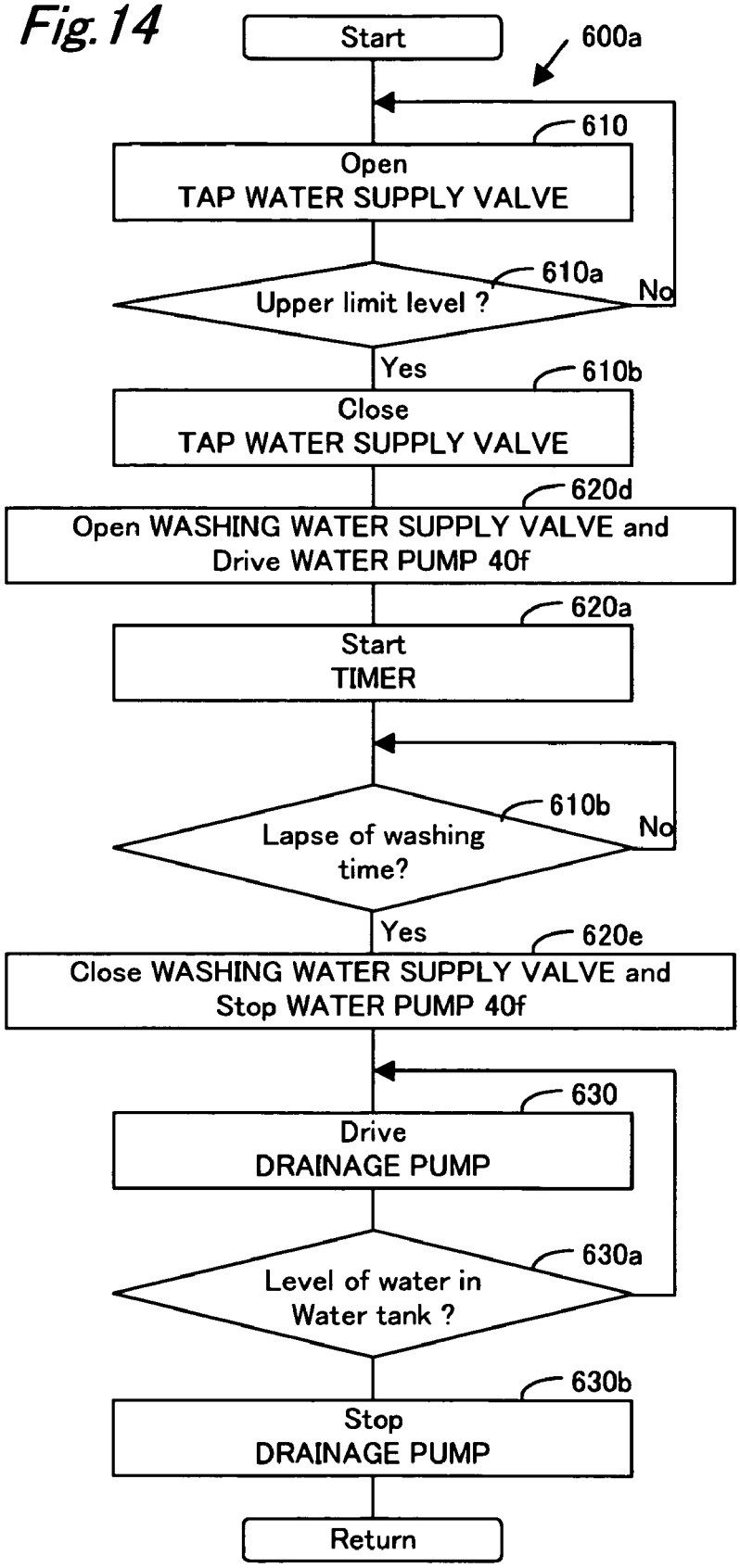
FIG. 14 is a flow chart of a washing routine shown in FIG. 12.

In the electric control circuit Ea, the control program executed by the microcomputer 80 in the first embodiment is modified as shown in a flow chart of FIG. 12. In this modification, the flow chart of FIG. 3 is modified as shown in FIG. 12, the flow chart of FIG. 5 is modified as shown in FIG. 13, and the flow chart of FIG. 6 is modified as shown in FIG. 14. In the electric control circuit Ea, a stored ice detection switch 70*d* and driving circuits 90*h*, 90*i*, 90*j* are added as shown in FIG. 11, the driving circuits 90, 90*a* in the first embodiment are removed.

The stored ice detection switch 70*d* is arranged to detect an amount of ice cubes 20*d* stored in the ice storage cabinet 20*c* as shown in FIG. 10. The driving circuit 90*h* is activated under control of the computer 80 to open and close the defrost water supply valve 40*n*. The driving circuit 90*i* is activated under control of the computer 80 to open and close the washing water supply valve 40*q*. The driving circuit 90*j* is activated under control of the computer 80 to drive the water supply pump 40*k*. The other construction of the electric control circuit Ea is the same as that in the first embodiment.

When the operation switch 70 in the fourth embodiment is operated to activate the ice making machine, the computer 80 initiates to execute processing of the ice making routine 100 of the control program as shown in FIG. 12. In processing of the ice making routine 100, the electromagnetic line valve 50*d* is opened, the hot gas valve 50*f* is closed, and the compressor 50*a* and water pump 40*f* are driven under control of the computer 80 in the same manner shown in the flow chart of FIG. 4. Thus, in the freezing circuit 50A, the refrigerant of high temperature under high pressure from the compressor 50*a* flows through the condenser 50*b*, air-liquid separator 50*c* and expansion valve 50*e* and is circulated into the evaporator 50*g* in the form of refrigerant of low temperature under low pressure. In turn, the ice making plates 20*a* are cooled by the refrigerant circulated into the evaporator 50*g*, and the refrigerant is circulated to the compressor 50*a*.

In such operation, the water pump 40*f* is driven by activation of the driving circuit as in the first embodiment to supply ice making water from the water tank 40 to the upper side sprinkler 30*b* through the conduit 40*e*. The ice making water is spouted to the ice making plates 20*a* from the nozzles 32 of sprinkler 30*b* and falls along the ice making plates. Thus, the ice making water circulates into the water tank 40.

In such a manner as described above, the ice making machine is operated at the ice making mode such that the ice making water falling along the ice making plates 20*a* is frozen by the evaporator 50*g* and formed into ice cubes on the ice making plates. In the course of growth of ice cubes, the ice making water in water tank 40 decreases. When the level of ice making water in water tank 40 lowers less than the lower limit level, the computer 80 determines a "Yes" answer at step 100*a* of FIG. 3 in response to a detection signal from the water level sensor 70*a* and causes the program at step 200*b* to proceed to a defrost routine 200*b* shown in FIG. 13.

In the defrost processing routine 200*b*, the water pump 40*f* is stopped by processing at step 210, the hot gas valve 50*f* is opened by processing at step 220, and the electromagnetic line valve 50*d* is closed by processing at step 230 as in the first embodiment. Thus, the compressed refrigerant from compressor 50*a* flows as hot gas into the evaporator 50*g* through the hot gas valve 50*f*. In such an instance, the water pump 40*k* is driven by activation of the driving circuit 90*j* under control of the computer at step 250 to supply defrost water from the defrost water tank 40*i* to the lower side sprinkler 30*c* through the conduit 40*j*. The defrost water is spouted to the upper portions of ice making plates 20*a* from the nozzles 33 of sprinkler 30*c* and falls along the back surfaces of ice making plates 20*a* to be circulated into the water tank 40 across the meshed guide member 20*b*.

In operation at the defrost mode described above, the ice cubes formed on the ice making plates 20*a* are molten by the defrost water falling along the back surfaces of ice making plates 20*a* and the hot gas flowing into the evaporator 50*g* and released from the ice making plates to be stored in the ice storage cabinet 20*c*.

When the temperature of refrigerant at a position near the outlet portion of evaporator 50*g* rises more than the predetermined temperature in operation at the defrost mode, the computer determines a "Yes" answer at step 200*a* in response to a detection signal from the temperature sensor. When the "Yes" answer is determined at step 200*a*, the compressor 50*a* is stopped by processing at step 300, and the drainage pump 40*h* is driven by processing at step 300*a* to drain the ice making water from the water tank 40 as in the first embodiment.

When the level of ice making water in water tank 40 becomes the lowest level, the computer determines a "Yes" answer at step 300*a* in response to a detection signal from the water level sensor and executes processing for stopping the drainage pump 40*h* at step 300*b*. Thus, the drainage pump 40*h* is stopped under control of the computer to finish drain of the ice making water from the water tank 40.

Subsequently, the computer determines at step 500*a* whether the ice storage cabinet 20*c* has been filled with ice cubes or not. If the answer is "No", the tap water supply valve 40*d* is opened by processing at step 800*c* to supply the tap water as ice making water to the water tank 40 through the tap water supply conduit 40*c*. When the level of ice making water in the water tank 40 rises more than the upper limit level, the computer 80 determines a "Yes" answer at step 800*a* in response to a detection signal from the water level sensor 70*a* and executes processing for closing the tap water supply valve 40*d* at step 800*d*. Thus, the tap water supply valve 40*d* is closed by processing at step 800*d* to interrupt supply of the tap water to the water tank 40. Thereafter, the defrost water supply valve 40*n* is opened by processing at step 800*e* for a predetermined time to supply the tap water as defrost water to the defrost water tank 40*i* through the defrost water supply conduit 40*m*.

After processing at step 800*e*, the computer 80 determines at step 800*f* whether the ice storage tank 20*c* has been filled with ice cubes or not. When the ice cubes are not fully stored in the storage cabinet 20*c*, the computer determines a "Yes" answer at step 800*f* in response to a detection signal from the stored ice detection switch 70*d*. Thereafter, the operation at the ice making mode and the defrost mode is repeated by processing at step 500*a* until the ice cubes are fully stored in the ice storage cabinet 20*c*.

During such operation of the ice making machine as described above, the ice making water in water tank 40 is drained at each finish of operation at the defrost mode, and the water tank 40 is supplied with fresh ice making water in operation at the subsequent ice making mode to produce ice cubes of the fresh water in a clean condition. When the ice cubes are fully stored in the ice storage cabinet 20*c*, the computer determines a "Yes" answer at step 500*a* in response to a detection signal from the stored ice detection switch 70*d* and executes at step 600*a* processing of a washing routine shown in FIG. 14.

During processing of the washing routine 600*a*, the tap water supply valve 40*d* is opened by processing at step 610 to supply tap water for washing into the water tank 40. When the level of tap water for washing in water tank 40 rises up to the upper limit level, the tap water supply valve 40*d* is closed by processing at step 610*b*. Thereafter, the washing water supply valve 40*q* is opened and the water supply pump 40*f* is driven by processing at step 620*d* to supply the tap water for washing from the water tank 40 to the upper side sprinkler 30*b* through the conduit 40*e* and to the lower side sprinkler 30*c* through the conduit 40*p*, washing water supply valve 40*q* and conduit 40*j*.

Thus, the tap water for washing is spouted from the nozzles of upper side sprinkler 30*b* toward each upper portion of the ice making plates 20*a* and is spouted from the nozzles of lower side sprinkler 30*c* toward the back surfaces of ice making plates 20*a*. The tap water for washing from the upper side sprinkler 30*a* falls along the ice making surfaces of plates 20*a* and circulates into the water tank 40 across the meshed guide member 20*b*. The tap water for washing from the lower side sprinkler 30*c* falls along the back surfaces of ice making plates 20*a* and the evaporator 50*g* and circulates into the water tank 40.

After finish of the processing at step 620*d*, the timer 70*b* of the computer is reset at step 620*a* to start measurement of a predetermined time for washing. Accordingly, the computer repeatedly determines a "No" answer at step 620*b* during lapse of the predetermined time for washing, and the ice making plates 20*a* and evaporator 50*g* are washed by the tap water for washing during operation of the water pump 40*f* under control of the computer. Upon lapse of the predetermined time for washing, the computer determines a "Yes" answer at step 620*b* and executes processing for closing the washing water supply valve 40*q* and for stopping the water pump 40*f* at step 620*e*. Thus, the washing water supply valve 40*q* is closed, and the water pump 40*f* is stopped to stop the supply of the tap water for washing to the sprinklers 30*b*, 30*c*. After processing at step 620*e*, the drainage pump 40*h* is driven by processing at step 630–630*b* to drain the washing water from the water tank 40 as in the first embodiment.

As is understood from the above description, the water tank 40 is supplied with fresh tap water for washing from the source of tap water through the tap water supply valve 40*d* after the ice making water was drained therefrom, and the ice making plates 20 and evaporator 50*g* are cleanly washed by the fresh tap water spouted from the upper and lower side sprinklers 30*b*, 30*c* during operation of the water pump 40*f*. Accordingly, the water circulation system such as the sprinklers 30*b*, 30*c*, ice making plates 20*a*, meshed guide member 20*b* and water tank 40 is washed with the fresh tap water. Thus, contaminants adhered to the water circulation system during operation at the ice making mode are cleanly eliminated with the fresh tap water. As a result, the water circulation system is maintained in a clean condition.

When the ice storage cabinet 20*c* is filled with the ice cubes, the computer determines a "Yes" answer at step 500*a* in response to a detection signal from the stored ice switch 70*d* and executes the processing of the washing routine 600*a*. Accordingly, the water circulation system is automatically washed without any working for washing during operation of the ice making machine at the ice making mode. This is useful to maintain the ice making machine in a clean condition in a simple manner.

When the processing of the washing routine 600*a* is finished, the processing at step 800*c*–800*e* is executed by the computer to open the water supply valve 40*d* for supplying fresh tap water into the water tank 20*c* from the source of tap water until the level of fresh tap water in tank 20*c* rises up to the upper limit level and to open the defrost water supply valve 40*n* for supplying defrost water into the defrost water tank 40*i*. Thereafter, the computer determines a "No" answer at step 800*f* since the ice storage cabinet 20*c* is filled with the ice cubes.

In actual practice of the present invention, underground water may be used as the washing water in stead of the tap water. In the embodiments described above, the drainage timing of the ice making water and washing water from the water tank 40 is determined by detection of the water level sensor 70*a*. In the case that the ice making water and washing water from the water tank may not be fully drained only by detection of the water level sensor, the drainage pump 40*h* may be driven for a predetermined time after the lowest level of water in the water tank was detected by the water level sensor 70*a*. In such a case, the timer 70*b* can be used to measure the predetermined time for activation of the drainage pump 40*h*.

Although the ice making plates 20 in the above embodiments are made of aluminum to avoid corrosion caused by salt content, the ice making plates may be made of copper or stainless steel in the case where corrosion caused by slat water can be prevented by washing of the water circulation system.

The invention claimed is:

1. An ice making machine comprising a water tank for storing an amount of ice making water, an upright ice making plate arranged above the water tank, and an water sprinkler located immediately above the ice making plate to spray ice making water supplied from the water tank to the ice making plate so that the ice making water falls along the ice making plate, in which the ice making water sprayed to the ice making plate during operation at an ice making mode is frozen and formed into ice cubes in the course of falling along the ice making plate, characterized in that the ice making machine includes drainage means for draining the ice making water from the water tank, water supply means for supplying washing water into the water tank, and control means for activating the drainage means after finish of operation at a defrost mode and for activating the water supply means after the ice making water has been drained from the water tank, wherein the washing water supplied into the water tank under control of the control means is sprayed by the sprinkler for washing the ice making plate.

2. An ice making machine comprising a water tank for storing an amount of ice making water, an upright ice making plate arranged above the water tank, and a water sprinkler located immediately above the ice making plate to spray ice making water supplied from the water tank to the ice making plate so that the ice making water falls along the ice making plate, in which the ice making water sprayed to the ice making plate during operation at an ice making mode is frozen and formed into ice cubes in the course of falling alont the ice making plate, characterized in that the ice making machine includes operation means for washing, drainage means for draining the ice making water from the water tank, water supply means for supplying washing water into the water tank, and control means for activating the drainage means when the operation means for washing is operated and for activating the water supply means after the ice making water has been drained from the water tank, wherein the washing water for washing supplied into the water tank under control of the control means is sprayed by the sprinkler for washing the ice making plate.

3. An ice making machine comprising a water tank for storing an amount of ice making water, an upright ice making plate arranged above the water tank, and a water sprinkler located immediately above the ice making plate to spray ice making water supplied from the water tank to the ice making plate so that the ice making water falls along the ice making plate, in which the ice making water sprayed to the ice making plate during operation at an ice making mode is frozen and formed into ice cubes in the course of falling along the ice making plate, characterized in that the ice making machine includes an ice storage cabinet for storing an amount of ice cubes released from the ice making plate during operation at a defrost mode, detection means for detecting an amount of the ice cubes stored in the ice storage cabinet, drainage means for draining the ice making water from the water tank, water supply means for supplying fresh water for washing into the water tank, and control means for activating the drainage means in response to a detection signal from the detection means when the ice storage cabinet has been filled with the ice cubes and for activating the water supply means after the ice making water has been drained from the water tank, wherein the fresh water for washing is supplied into the water tank when the water supply means is activated under control of the control means and is sprayed by the water sprinkler for washing the ice making plate.

4. An ice making machines as set forth in claim 1, further including a guide duct for guiding the ice making water falling from the ice making plate during operation at a ice making mode and for guiding the ice cubes falling from the ice making plate during operation at a defrost mode, a water passage duct located at an intermediate portion of the guide duct for circulating the ice making water guided by the guide duct into the water tank, and ice crush means mounted within the guide duct for rotary movement and driven by an electric motor, wherein the ice crush means is driven by operation of the electric motor under control of the control means when the ice making machine is operated at the ice making mode and when the fresh water for washing supplied into the water tank in operation of the water supply means is sprayed by the water sprinkler.

* * * * *